US009511278B2

(12) United States Patent
Lee et al.

(10) Patent No.: US 9,511,278 B2
(45) Date of Patent: Dec. 6, 2016

(54) BASKETBALL GAME CONSOLE, NETWORK BASKETBALL GAME CONSOLE USING THE SAME, AND BASKETBALL METHOD

(75) Inventors: Kwang Yoon Lee, Gyeonggi-do (KR); Geun Seok Heo, Gyeonggi-do (KR); Kyung Moon Joo, Seoul (KR); Se Jin Park, Incheon (KR)

(73) Assignee: ANDAMIRO CO., LTD., Gyeonggi-Do (KR)

( * ) Notice: Subject to any disclaimer, the term of this patent is extended or adjusted under 35 U.S.C. 154(b) by 116 days.

(21) Appl. No.: 14/004,124

(22) PCT Filed: Mar. 9, 2011

(86) PCT No.: PCT/KR2011/001647

§ 371 (c)(1),
(2), (4) Date: Sep. 9, 2013

(87) PCT Pub. No.: WO2012/121434

PCT Pub. Date: Sep. 13, 2012

(65) Prior Publication Data

US 2014/0087796 A1 Mar. 27, 2014

(51) Int. Cl.
*A63F 9/24* (2006.01)
*A63F 7/06* (2006.01)
(Continued)

(52) U.S. Cl.
CPC ..... *A63F 7/0664* (2013.01); *A63B 63/083* (2013.01); *A63B 71/0669* (2013.01); *A63B 2063/086* (2013.01); *A63B 2220/806* (2013.01); *A63B 2225/09* (2013.01); *A63B 2225/10* (2013.01); *A63B 2225/15* (2013.01);
(Continued)

(58) Field of Classification Search
CPC ..... A63B 69/0071; A63B 63/083; A63F 2009/2442; A63F 2009/2488; A63F 2300/8011; A63F 7/0664
See application file for complete search history.

(56) References Cited

U.S. PATENT DOCUMENTS 4,956,775 A * 9/1990 Klamer et al. ..... 473/480
4,999,603 A * 3/1991 Mele et al. ..... 340/323 R
(Continued)

FOREIGN PATENT DOCUMENTS

CN 2014-005041 A1 1/2014
JP H07-124280 A 5/1995
(Continued)

OTHER PUBLICATIONS

International Search Report for PCT/KR2011/001647.

*Primary Examiner* — Steve Rowland
(74) *Attorney, Agent, or Firm* — The PL Law Group, PLLC

(57) ABSTRACT

There are provided a basketball game console, a network basketball game console, and basketball method using the same. The invention includes an image detecting unit, an identification unit, a central processing unit, and a driving unit. The central processing unit controls such that images of a ball received in the image detecting unit are identified when a passing detection sensor detects signals. Therefore, it is possible to identify a color, pattern, or clean shot of the ball going into a rim. The game console allows a multi-play game so that it is possible to play more interesting games over a network.

7 Claims, 18 Drawing Sheets

(51) Int. Cl.
*A63B 63/08* (2006.01)
*A63B 71/06* (2006.01)

(52) U.S. Cl.
CPC ..... *A63B 2225/20* (2013.01); *A63B 2225/30* (2013.01); *A63B 2243/0037* (2013.01)

(56) References Cited

U.S. PATENT DOCUMENTS

| | | | | |
|---|---|---|---|---|
| 6,186,911 | B1 * | 2/2001 | Manthey | 473/486 |
| 6,389,368 | B1 * | 5/2002 | Hampton | 702/179 |
| 6,984,129 | B1 * | 1/2006 | Jordan | 434/248 |
| 2005/0075153 | A1 | 4/2005 | Valero Moreno | |
| 2005/0143154 | A1 * | 6/2005 | Bush | A63F 13/12 463/4 |
| 2009/0191988 | A1 * | 7/2009 | Klein | 473/480 |

FOREIGN PATENT DOCUMENTS

| | | | |
|---|---|---|---|
| KR | 20-1996-0026763 | U | 8/1996 |
| KR | 20-1998-0060797 | A | 11/1998 |
| KR | 10-2003-0026192 | A | 3/2003 |
| KR | 10-2007-0010895 | A | 1/2007 |
| KR | 10-2010-0031051 | A | 3/2010 |
| TW | 2010-10776 | A | 3/2010 |

* cited by examiner (a)

(b)

(c)

BASKETBALL GAME CONSOLE, NETWORK BASKETBALL GAME CONSOLE USING THE SAME, AND BASKETBALL METHOD

CROSS REFERENCE TO RELATED APPLICATIONS AND CLAIM OF PRIORITY

This patent application is a National Phase application under 35 U.S.C. §371 of International Application No. PCT/KR2011/001647, filed Mar. 9, 2011, entire contents of which are incorporated herein by reference.

TECHNICAL FIELD

The present invention relates to a basketball game console, and more particularly, to a basketball game console that can identify a color, pattern, or clean shot of a ball going into a rim, and that includes a lighting device, a network basketball game console that enables multiple players to play a game with each other over a network using the basketball game console, and a method thereof.

BACKGROUND ART

Recently, it has been possible to enjoy basketball at any location with a court having a basketball rim, and basketball game consoles with added entertainment value have been spreading. In conventional basketball game consoles, when a user shoots a ball toward a fixed basketball rim for a predetermined time, the number of balls going into the rim is checked using a goal detection sensor, and a score is displayed. When the score is more than a predetermined score in a given time, several seconds are offered as additional bonus time.

Recently, game consoles with built-in digital technology, such as a detection sensor, have been developed and added to such basketball game consoles, whereby the ball going into the rim is detected and the score is automatically adjusted. These examples of increasing convenience associated with the gaming experience have been realized.

However, since such conventional game consoles only determine whether the ball simply goes into the rim with the resulting score displayed, it is difficult to provide various game effects. Moreover, since the game proceeds with uniform functionality regardless of a player's skill level, it is difficult for beginners or unskilled players to easily play the game.

Furthermore, network games have become increasingly popular, wherein many players compete and enjoy games rather than single-player games.

Therefore, basketball game consoles where many players compete and enjoy the game are necessary.

SUMMARY

The present invention is directed to a basketball game console capable of identifying a color of a ball that identifies a color, pattern, and clean shot of a ball going into a rim. The basketball game console of the present invention also displays scores of various games, provides various services, such as lamp lighting or flashing and a bonus stage, offers free gifts, and the present invention includes a network game console using the same.

The present invention is directed to a basketball game console capable of adjusting a gradient of the rim according to a player's skill level and a network game console using the same.

The present invention is directed to a network basketball game console wherein a plurality of players can participate in and simultaneously enjoy games.

The present invention is directed to a network basketball game console that can display game progress information when a network game is played.

The present invention is directed to a network basketball game console that can offer a game time and a weighted value according to a success rate or a player's skill level.

The present invention is directed to a basketball game console and a network basketball game console that can notify a replacement time according to an wear degree of the ball.

According to an aspect of the present invention, there is provided a basketball game console, including: an image detecting unit configured to include a rim having an impact detection sensor, a passing detection sensor that is positioned in a lower end of the rim and detects whether a ball passes through the rim, a lens, and an image sensor for detecting images of the ball that has been transmitted to the lens; an identification unit configured to identify any one of a color, pattern, and clean shot of the ball in the detected images; a central processing unit configured to control a state according to the color, pattern, or clean shot of the ball identified in the identification unit when the ball going into the rim is detected from the passing detection sensor; and a driving unit configured to display shapes and execute corresponding operations under state control of the central processing unit, wherein the central processing unit controls such that the images of the ball detected in the image sensor through the lens are identified when the passing detection sensor detects signals.

According to another aspect of the present invention, there is provided a network basketball game console including: at least one basketball game console including, an image detecting unit that is positioned in a lower end of a rim having an impact detection sensor, detects a ball going into the rim, and detects images of the ball, an identification unit configured to identify any one of a color, pattern, and clean shot of the ball in the received images, a central processing unit configured to control a state according to the color, pattern, or clean shot of the ball identified in the identification unit when the ball going into the rim is detected from the image detecting unit, and display a screen necessary for game progress, and a driving unit configured to display shapes and execute corresponding operations under state control of the central processing unit; and a terminal that is connected to the central processing unit of each of the basketball game consoles over a wired or wireless network and communicates with each console, is configured to select a single-play game or multi-play game, and includes a display window for displaying information associated with each game.

A main terminal may be interconnected with each terminal that participates in the multi-play game, receives game progress information from the central processing unit of each of the terminals, determines a ranking by aggregating scores of the basketball game consoles participating in the multi-play game, obtains the highest score, and displays the highest score and ranking of a corresponding terminal in each basketball game console participating in the multi-play game.

When an average value of a goal success rate of each of the basketball game consoles is less than or greater than a preset average success rate value, the terminal may control each of the central processing units such that the success rate is adjusted to be closer to the average success rate value.

When a goal success score is determined to be a beginner level, the terminal may extend a gameplay time of a corresponding basketball game console or offer a bonus score.

The basketball game console may further include at least one lighting device, controlled by the central processing unit wherein the lighting device turns on when the passing detection sensor or impact detection sensor detects signals.

The central processing unit may output a message for notifying whether a color ball is present or for notifying replacement when the color shot is not recognized during a predetermined number of balls going into the rim, thereby changing an worn ball.

The rim may include a rim fixing unit of which one end is coupled to one side of a backboard and the other end is formed to protrude from the backboard, and a rim supporting unit formed to be extended from one end of a basketball rim, wherein the other end of the rim fixing unit and the rim supporting unit are coupled with each other with an impact alleviation device.

The impact alleviation device may include at least one length-adjustable joint member configured to couple the other end of the rim fixing unit and the rim supporting unit, and a buffer material that is inserted and installed in the joint member, thereby capable of adjusting the gradient of the rim.

According to still another aspect of the present invention, there is provided a network basketball game method that uses at least one basketball game console including a central processing unit configured to obtain game progress information and display the information on a display window, and a terminal that is configured to be included in each basketball game console and is configured to be connected with the central processing unit of each basketball game console over a wired or wireless network and communicates with each console, the method including: a) selecting a multi-play game in the terminal and starting the game; b) receiving, by a preset main terminal, the game progress information from the central processing unit of each of the basketball game consoles that participate in the multi-play game; and c) determining, by the main terminal, a ranking by aggregating scores of the basketball game consoles that participate in the multi-play game in the obtained information, obtaining the highest score, and displaying the highest score and ranking of a corresponding terminal on each of the basketball game consoles that participate in the multi-play game.

The game progress information in operation b), above, may include scores according to any one of a color, pattern, and clean shot of a ball going into a rim in the basketball game console.

The main terminal may control each of the central processing units such that a success rate is adjusted to be closer to a preset average success rate value when an average value of goal success rates of each basketball game console in the obtained information is less than or greater than the preset average success rate value.

The main terminal may control a corresponding basketball game console such that a weighted value is added to be closer to the average success rate value when an average value of goal success rate of each of the basketball game consoles in the obtained information is less than or greater than the preset average success rate value, and an error message is output on a display or as a sound when the success rate is lower than a predetermined level.

The main terminal may control a gameplay time of the corresponding basketball game console wherein gameplay time is extended or a bonus score is added when a goal success score is determined to be a beginner level in the obtained information.

The central processing unit may output a message for notifying whether a color ball is present in the corresponding basketball game console or for notifying replacement when the color shot is not recognized during a predetermined number of balls going into the rim, thereby changing the worn ball.

According to the basketball game console and the network basketball game console using the same, it is possible to display scores of various games and provide various services such as lamp lighting or flashing, a bonus stage, and offering free gifts by identifying a color, pattern, and clean shot of the ball going into the rim.

According to the invention, since the gradient of the rim can be adjusted depending on the player's skill level, it is possible for beginners or unskilled players to enjoy more interesting games.

Moreover, according to the invention, since many people can simultaneously play games, it is possible to check one another's progress, rankings, and accordingly enjoy more competitive games.

Although many players can participate in the game, since it is possible to adjust the difficulty level of the games according to a respective game/player skill level, more players can enjoy fair/equal gameplay.

According to the invention, since it is possible to check an wear state of the ball, players can enjoy fair gameplay.

DETAILED DESCRIPTION

Terms and words used in this specification and claims should not be interpreted as limited to commonly used meanings or meanings in dictionaries and should be interpreted with meanings and concepts which are consistent with the technological scope of the invention based on the principle that the inventors have appropriately defined concepts of terms in order to describe the invention in the best way.

Throughout this specification, when a certain part "includes" a certain component, this means that another component may be further included and does not exclude another component unless otherwise defined. Moreover, terms such as "part," "unit," "module," and "device," described in the specification refer to a unit of processing at least one function or operation, and may be implemented as hardware or software or a combination thereof.

Hereinafter, an embodiment of the invention will be described with reference to the accompanying drawings.

Figure 1:
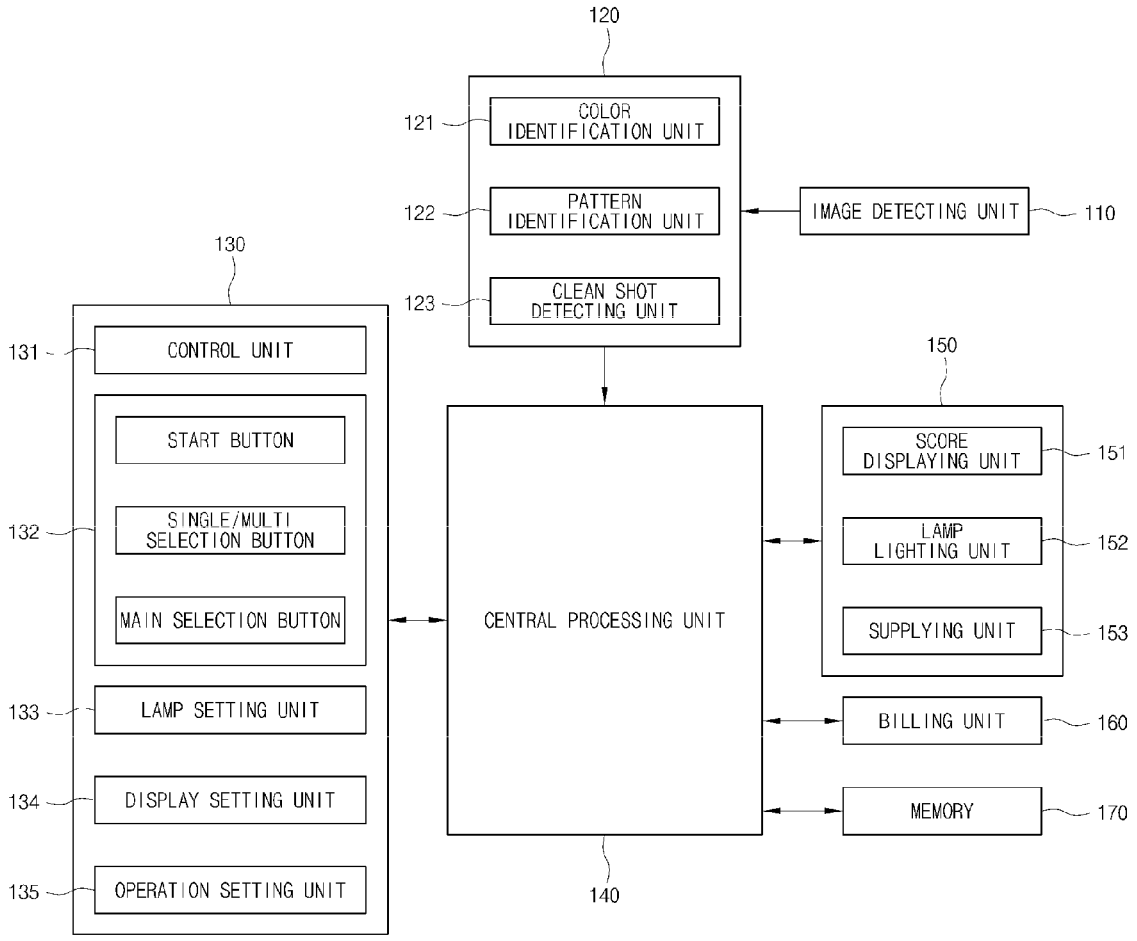
FIG. 1 is a block diagram illustrating a network basketball game console that identifies a color, pattern, or clean shot of a ball according to one embodiment of the invention.

FIG. 1 is a block diagram illustrating a network basketball game console that identifies a color, pattern, or clean shot of a ball according to the embodiment of the invention.

As illustrated in FIG. 1, the network basketball game console according to the invention includes an image detecting unit 110, an identification unit 120, a terminal 130, a central processing unit 140, and a driving unit 150.

The image detecting unit 110 is configured to detect whether the ball passes through a rim 116 and goes into the rim, and to detect images of the ball going into the rim.

The image detecting unit 110 will be described in detail with reference to drawings.

Figure 3:
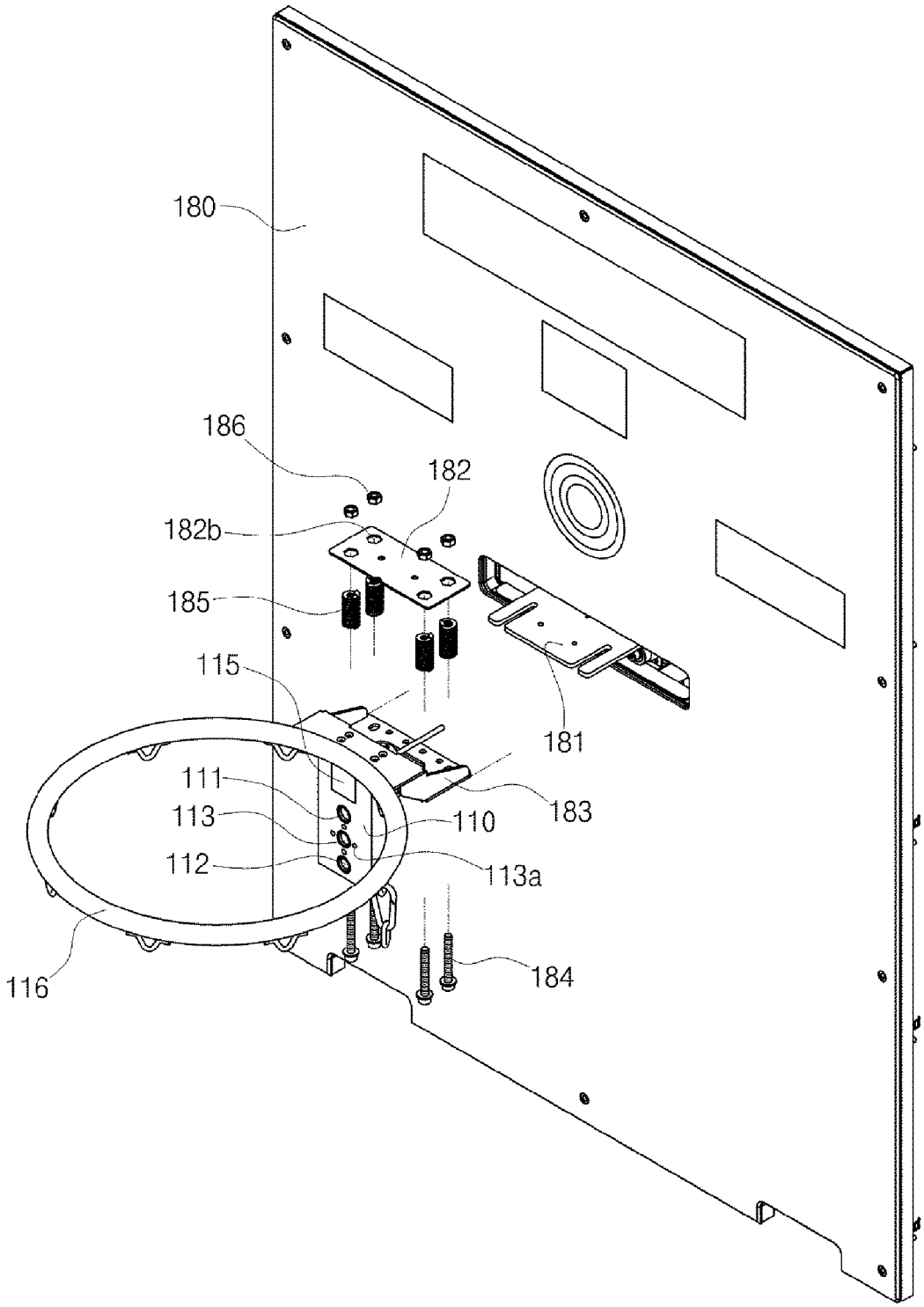
FIG. 3 is an exploded perspective view of a rim according to the invention.
Figure 4:
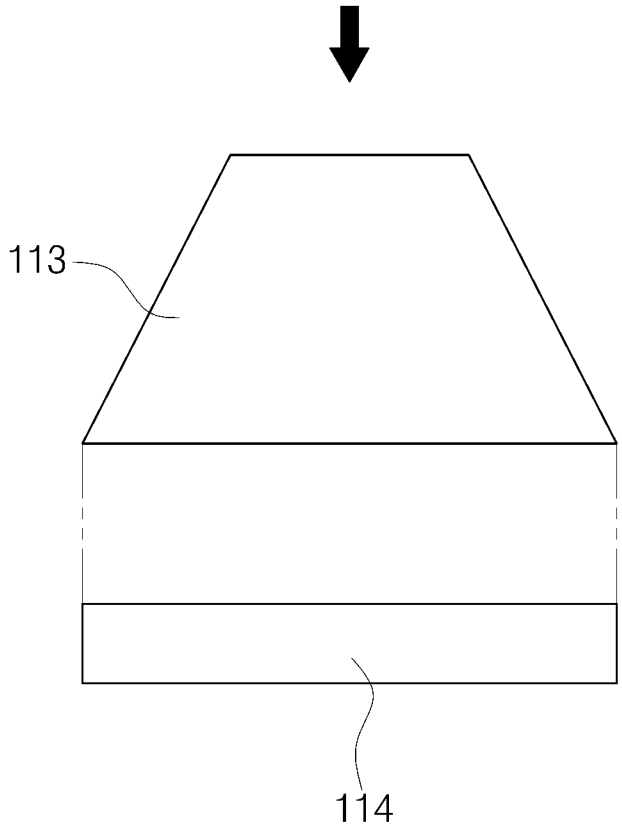
FIG. 4 is a reference diagram illustrating an image sensor and a lens according to the invention.

FIG. 3 is an exploded perspective view of the rim, and FIG. 4 is a diagram illustrating an image sensor and a lens. The image detecting unit 110 includes an impact detection sensor 115 that is positioned at a lower end of the rim 116 and detects an impact, passing detection sensors 111 and 112 for detecting whether the ball passes through the rim 116, a lens 113 for detecting images, and an image sensor 114 for detecting images of the ball that has been transmitted to the lens 113.

The impact detection sensor 115 is configured to detect and output an impact signal of the rim 116 or a backboard 180. This detection signal is used as a signal for detecting a clean shot in the identification unit 120.

More specifically, the rim 116 includes a rim fixing unit 181 of which one end is coupled to one side of the backboard 180 and the other end is formed to protrude from the backboard 180, and a rim supporting unit 183 that is integrally formed into the rim 116, and of which one end is bent downward and the other end is configured with an extended-part. The other end of the rim fixing unit 181 and the rim supporting unit 183 are coupled each other with impact alleviation devices 182, 184, 185, and 186.

The impact alleviation devices 182, 184, 185, and 186 include at least one of joint members 184 and 186 that couple the other end of the rim fixing unit 181 and the rim supporting unit 183, and a buffer material 185 that is inserted and installed in each of the joint members 184 and 186.

These joint members 184 and 186 are made of a member capable of adjusting a length so that it is possible to assemble, in that a front part of the rim tilts up or down with respect to a rear part (backboard direction) of the rim.

Figure 5:
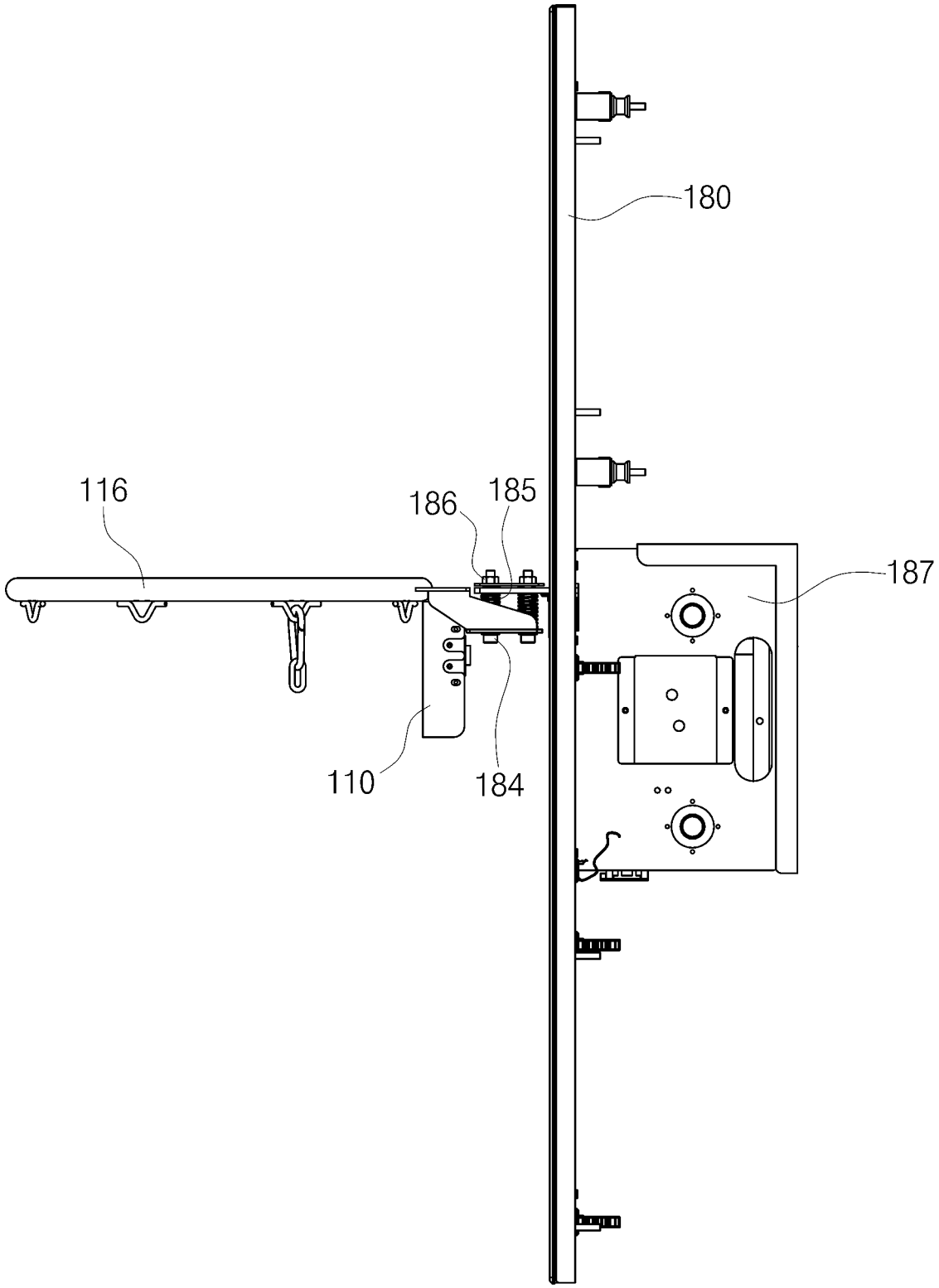
FIG. 5 is a side view illustrating an example of a coupling state of the rim according to the invention.
Figure 6:
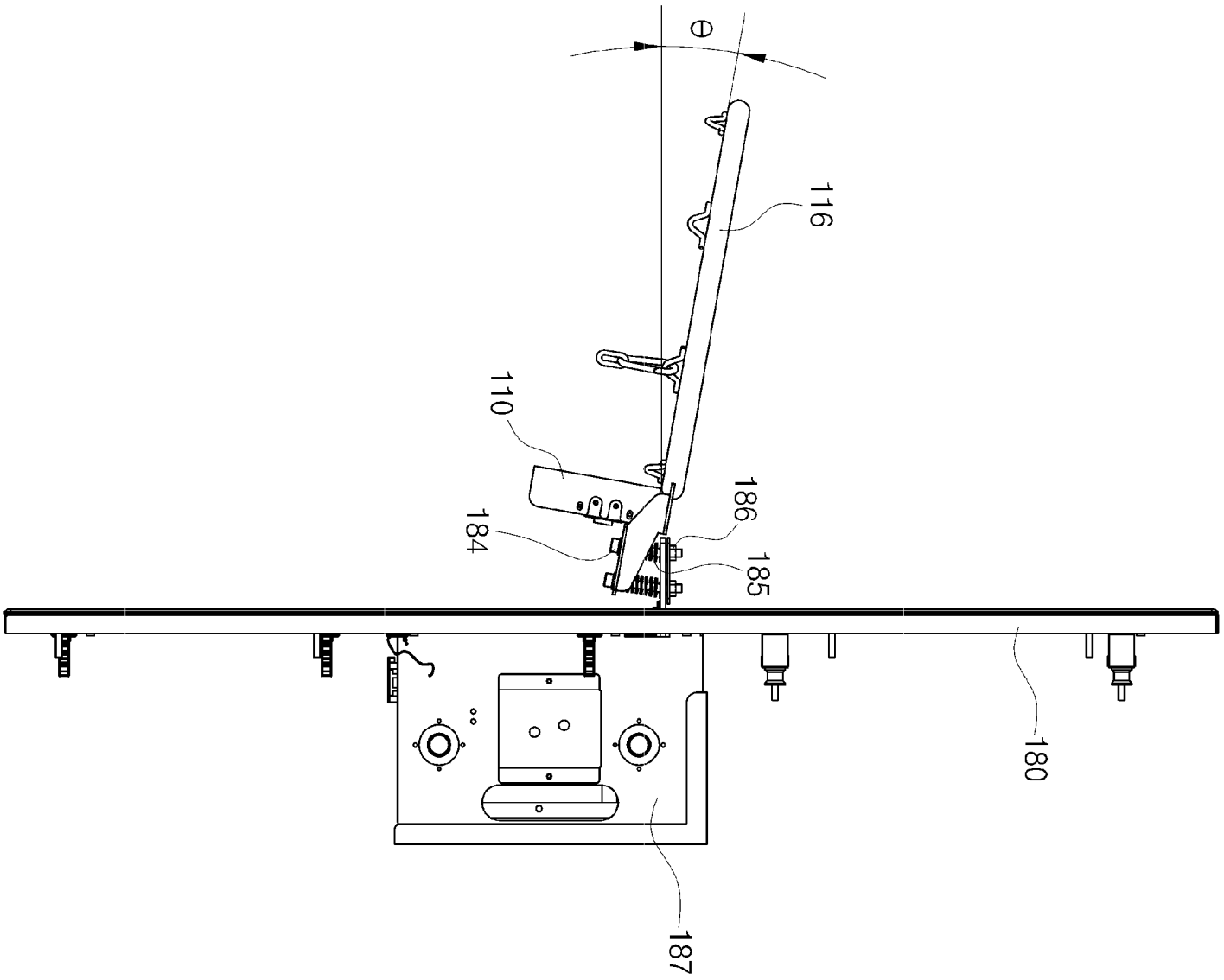
FIG. 6 is a diagram illustrating a state in which a gradient of the rim is adjusted in an upward direction.
Figure 7:
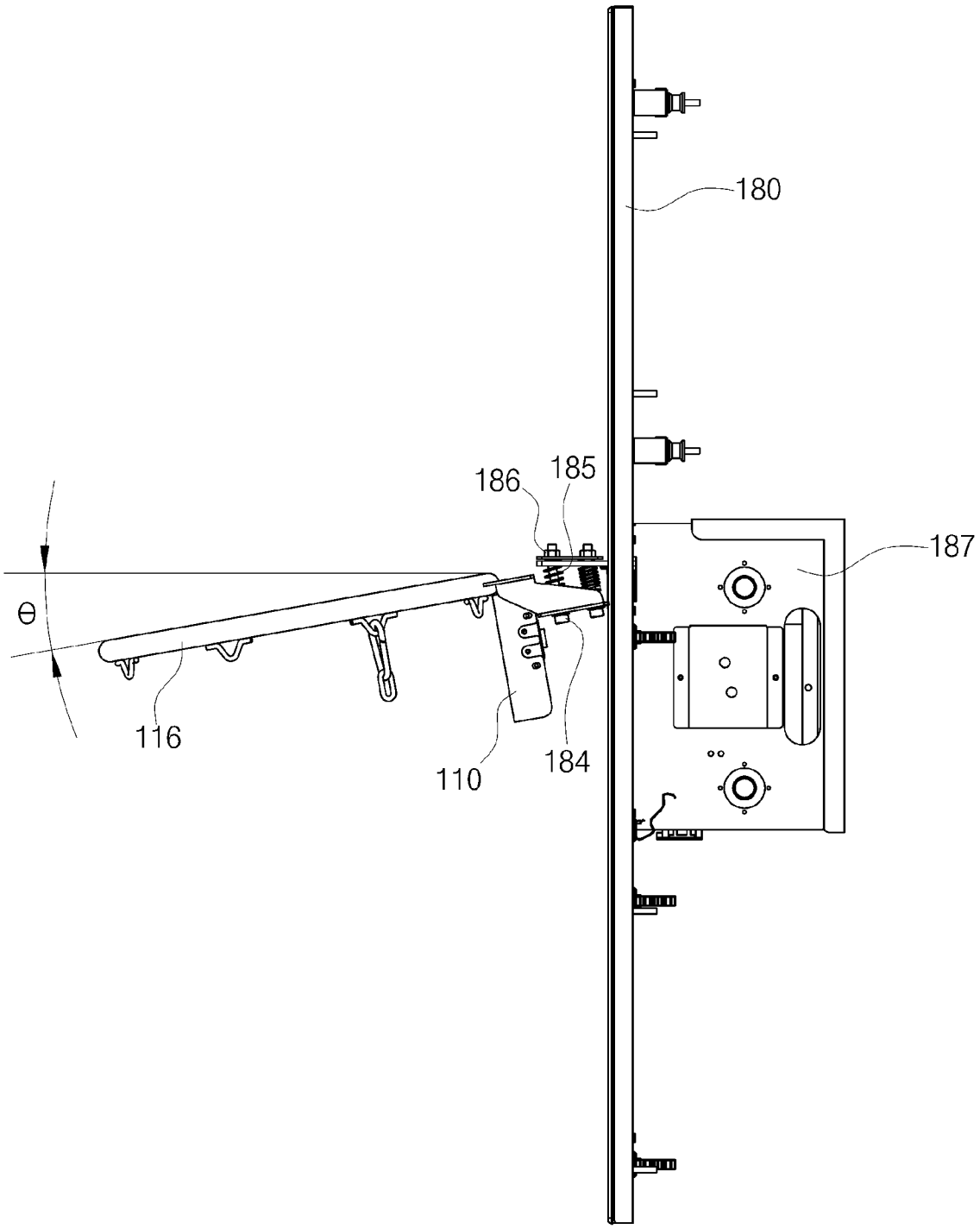
FIG. 7 is a diagram illustrating a state in which the gradient of the rim is adjusted in a downward direction.

FIG. 5 is a side view illustrating an example of a coupling state of the rim. FIG. 6 is a diagram illustrating a state in which a gradient of the rim is adjusted in an upward direction. FIG. 7 is a diagram illustrating a state in which the gradient of the rim is adjusted in a downward direction. FIG. 5 represents a state in which the gradient of the rim is adjusted horizontally. Each of the joint members 184 and 186 positioned closer to the rim and closer to the backboard is assembled to have a constant length so that horizontal orientation is maintained.

As illustrated in FIG. 6, in order for the gradient of the rim to be adjusted in the upward direction, a length of the joint member closer to the rim between the joint members 184 and 186 is decreased so that the rim 116 is adjusted in the upward direction by an angle of θ.

As illustrated in FIG. 7, in order for the gradient of the rim to be adjusted in the downward direction, a length of the joint member closer to the backboard between the joint members 184 and 186 is decreased so that the rim 116 is adjusted in the downward direction by an angle of θ. Therefore, it is possible to enjoy a more interesting game by adjusting the gradient of the rim depending on a player's skill level.

The above passing detection sensors 111 and 112 include a first detection sensor 111 and a second detection sensor 112. The first detection sensor 111 is installed at the lower end of the rim 116 to easily detect the ball passing through the rim.

The second detection sensor 112 is installed at a lower end of the image sensor 114, and turns on a lighting device 113*a* when the sensor detects signals. Therefore, images of the ball going into the rim may be clearly recognized in the image sensor 114.

The lighting device 113*a* uses LEDs having good durability, and a plurality of lighting devices are installed around the lens 113 in order to clearly detect images of the ball.

It is preferable that the lighting device 113*a* be controlled to turn on when the passing detection sensors 111 and 112 or the impact detection sensor 115 detects signals.

According to one embodiment of the invention, the lighting device 113*a* is installed around the lens 113. However, installation position(s) of the lighting device 113*a* is/are without limitation, particularly when the image sensor 114 allows the images of the ball to be more clearly detected.

The identification unit 120 is operated to identify any one of a color, pattern, or clean shot of the ball in the images detected in the image detecting unit 110.

To this end, the identification unit 120 may include a color identification unit 121 and a pattern identification unit 122 to identify a color or pattern of the ball, and a clean shot detecting unit 123 to detect a clean shot. The color identification unit 121, the pattern identification unit 122, and the clean shot detecting unit 123 may be configured alone or in combination.

The color identification unit 121 is operated to identify a color of the ball going into the rim 116.

Therefore, the color identification unit 121 stores color data to be identified by a user in a memory, sequentially radiates light sources of red, green, and blue to a ball of which a color is to be detected, calculates a ratio of quantity of reflected light, identifies a color of the detected ball, compares color data of the identified and detected ball with the color data stored in the memory, and determines whether the colors match.

It is preferable that the color identification unit 121 be configured with a reflective photo sensor (not shown) or a color-detecting sensor (not shown).

Figure 8:
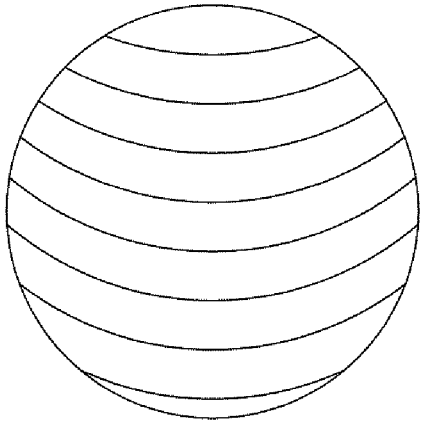
FIG. 8 is a diagram illustrating balls having a variety of patterns according to the invention.
Figure 8:
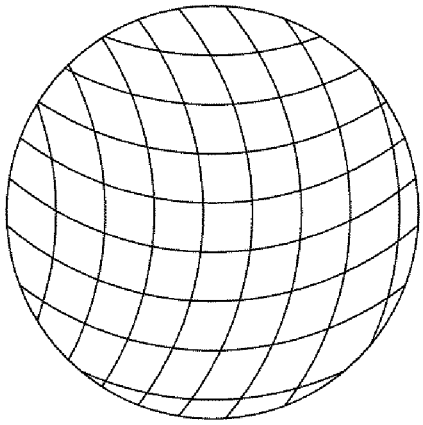
Figure 8:
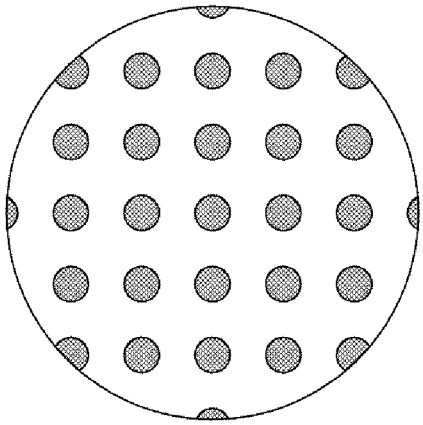

The pattern identification unit 122 is configured to identify patterns of the ball going into the rim 116. As illustrated in FIG. 8, examples of identifiable patterns may include various forms of patterns such as stripes, checkers, and spots. The term "pattern" used herein is without limitation and includes all forms of identifiable patterns in broad terms, for example, barcodes or QR codes.

The pattern identification unit 122 according to the invention stores pattern data to be identified by the user in the memory, detects a pattern form by capturing a target object of which the pattern is to be detected, compares pattern data of the identified and detected object with the pattern data stored in the memory, and determines whether the patterns match. Accordingly, it is preferable that the pattern identification unit 122 include an imaging camera (not shown).

The central processing unit 140 receives the identified pattern of the ball from the pattern identification unit 122, compares and determines the pattern with the pre-stored pattern, displays a determination state, and controls a system with set content.

Therefore, the user may previously set a bonus score, for example, 50 points for a striped pattern, 30 points for a checkered pattern, and 10 points for a spotted pattern in the central processing unit 140. When the ball having a corresponding pattern goes into the rim 116, it is identified through the pattern identification unit 122, and it is additionally possible to display a respective bonus score in a score displaying unit 151 as well as to a default score under control of the central processing unit 140.

In an alternative example, the default score is given first according to the number of balls going into the rim, and a respective bonus score corresponding to the pattern as well as the default score may be additionally displayed.

In still another example, a function of a lamp flashing or lighting is preset such that three lamps are lit for the striped pattern, two lamps are lit for the checkered pattern, and one lamp is lit for the spotted pattern. When a ball having a corresponding pattern goes into the rim, the lamps light up, according to the pattern of the ball, in various forms in a lamp lighting unit 152, wherein the enjoyment of the game can be doubled.

The clean shot detecting unit 123 detects a clean shot. When the image detecting unit 110 detects the ball going into the rim, the clean shot detecting unit determines whether the ball is a clean shot, and then offers free gifts or a bonus score, or displays additional effects, thereby increasing interest in the game.

To this end, the clean shot detecting unit 123 determines whether the ball is a clean shot based on a signal detected in the impact detection sensor 115.

In general, while the clean shot refers to a successful shot that has passed through the rim without hitting the backboard 180 or the rim 116 (i.e., a swish or "nothing-but-net"), the invention includes as a clean shot, a case in which the first detection sensor 111 installed at the lower end of the rim 116 is operated within a predetermined time after the impact detection sensor 115 detects an impact signal.

More specifically, since the impact detection sensor 115 detects signals when a basketball hits the rim 116 and the backboard 180, the ball going into the rim is not accepted as a clean shot while the impact detection sensor 115 is active.

However, considering a case in which the basketball directly hits inside of the rim and goes into the rim, the invention determines this case as a clean shot in order to increase the success rate of the clean shot.

Therefore, the clean shot detecting unit 123 accepts a case wherein the impact detection sensor 115 detects signals simultaneously with the first detection sensor 111 detecting signals, as a clean shot.

According to one embodiment of the invention, the impact detection sensor 115 is installed in the rim 116. However, the sensor may be installed, without limitation, in any place wherein vibrations of the backboard or rim can be detected.

The terminal 130 controls a display state of a device according to input user commands, and transmits and receives game progress information with a main terminal set when a network game is played.

To this end, the terminal 130 may include a control unit 131, an input unit 132, a lamp setting unit 133, a display setting unit 134, and an operation setting unit 135.

The input unit 132 includes, for example, a start button for starting a game, a single/multi selection button for selecting either a single-play game or multi-play game, and a main selection button for setting the main terminal when the network game is played.

Moreover, a score setting button (not shown) for setting different scores for each color, pattern, and clean shot may be further included.

When the multi-play is selected in the input unit 132, wherein the game is played via the network, the control unit 131 is electrically connected to each central processing unit 140, and controls whereby data according to the game progress of each basketball game console (e.g., a success rate and score of each game console) is received and is displayed.

When the multi-play game is selected and a corresponding terminal 130 is selected as the main terminal, the control unit 131 controls whereby the main terminal is interconnected with each terminal that participates in the multi-play game, receives game progress information from the central processing unit 140 of each terminal 130, determines a ranking by aggregating scores of the game consoles participating in the multi-play game, obtains the highest score, and displays the highest score and ranking of the corresponding terminal in each game console that participates in the multi-play game.

The main terminal may be selected by any terminal that participates in the multi-play game, or a terminal that does not directly participate in the game may be selected as the main terminal.

Figure 9:
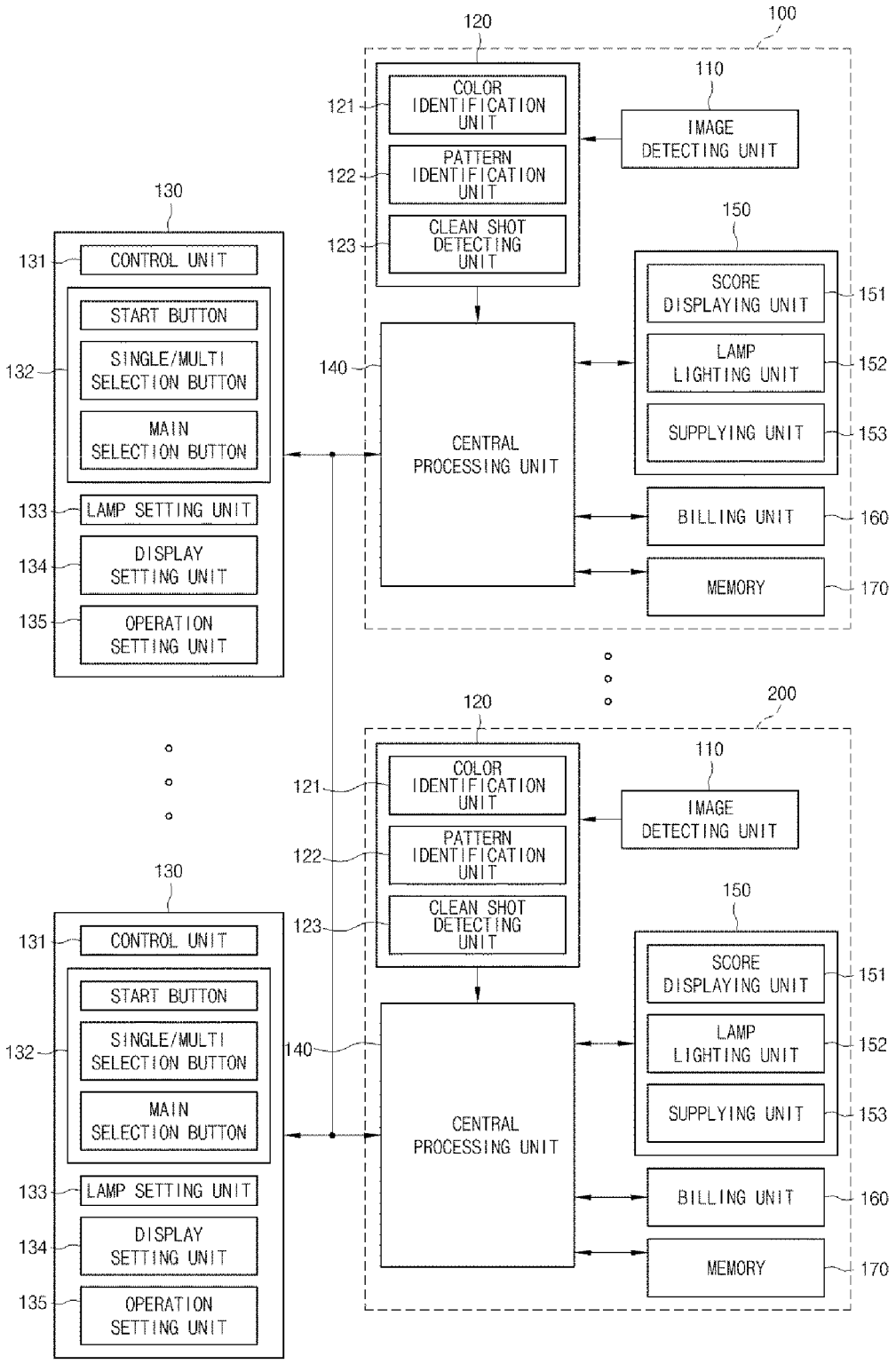
FIG. 9 is a block diagram illustrating a configuration of a network game console according to the embodiment of the invention.

An example of the network basketball game console is illustrated in FIG. 9.

FIG. 9 is a block diagram illustrating a configuration of the network basketball game console according to one embodiment of the invention. As illustrated in FIG. 9, the network basketball game console includes a plurality of basketball game consoles 100 and 200, and the central processing unit and the terminal of each basketball game console are electrically connected to each other.

When each terminal 130 selects the multi-play game using the single/multi selection button in order to participate in the network game, the terminals that participate in the multi-play game are electrically interconnected and exchange information necessary for the network game.

When the terminal is selected as the main terminal, the main terminal receives a variety of information necessary for game progress from each terminal, analyzes the information, and offers an appropriate measure of compensation.

For example, the main terminal obtains an average value of all sensors based on the game consoles connected over the network and manages balance such that any device has the same ratio of a recognition rate of all sensors.

This prevents a bias towards players due to devices having different clean shot and color shot recognition ratios and allows for all playing the game to have the same conditions and opportunities.

The main terminal requests and receives clean shot and color shot sensor recognition rate statistics data for each terminal from a storage space for processing clean shot and color shot sensor recognition rate statistic average values of each terminal, stores the data in the storage space for processing statistics, analyzes the statistics data, and calculates all reference average correction values.

Such an average correction value is transmitted to each terminal that participates in the multi-play game as reference average correction values of the clean shot and color shot sensor recognition to correct each sensor.

Such game information is used to control each central processing unit 140 whereby a success rate is adjusted to be closer to a set average success rate value when an average value of goal success rates of each basketball game console is less than or greater than a preset average success rate value.

In this case, it is also controlled such that a weighted value is added to be closer to the average success rate value when the goal success rate is less than or greater than the preset average success rate value, or an error message is output on a display device or as a sound when the success rate is determined as lower than a predetermined level.

Moreover, when the goal success score is determined to be a beginner level, the main terminal may extend gameplay time of a corresponding basketball game console or offer a bonus score, thereby garnering more interest in additional games.

When the color shot is not recognized during a predetermined number of balls going into the rim, the central processing unit 140 of each terminal may output a message for notifying whether a color ball of the basketball game console is present or for notifying the need for replacement.

While the above functions have been described as functions of the main terminal when the multi-play game is played, similarly, when the terminal selects the single game mode, it is necessary to perform the same processes by analyzing progress information of its own basketball game console.

The lamp setting unit 133 sets different states of lamp lighting or flashing for each color or pattern. The display setting unit 134 sets display information necessary for the game when the multi-play game is played and displays a ranking and the highest score. The operation setting unit 135 sets an object supplying state for each color or pattern.

For example, the user may preset the bonus score as 50 points for red, 30 points for green, and 10 points for blue. When a ball having a corresponding color goes into the rim 116, each score may be displayed.

In another example, a default score is offered first according to the number of balls going into the rim, and the bonus score for each color in addition to the default score may be additionally displayed.

In still another example, a function of lamp flashing or lighting is preset such that three lamps are lit for red, two lamps are lit for green, and one lamp is lit for blue. When a ball having a corresponding color goes into the rim, the lamps according to the color of the ball are lit or flashing in various forms, and thereby enjoyment of the game can be doubled.

When the passing detection sensor detects signals, the central processing unit 140 identifies images of the ball detected in the image sensor 114 through the lens 113 in the identification unit 120, controls a state thereof according to the color, pattern, or clean shot of the identified ball, and displays the state in the driving unit 150.

The central processing unit 140 receives the color or pattern of the identified ball from the color identification unit 121 or the pattern identification unit 122, compares the received result with the color or pattern that is previously stored in a memory 170, and controls a state of the device.

To this end, the central processing unit 140 may include, for example, a general CPU, MPU, MICOM, and microprocessor having functions of comparison, operation, and determination.

Moreover, the memory 170 is further included. The memory 170 may store a color or pattern of the ball in advance and provide corresponding data when the central processing unit 140 requires the data.

The driving unit 150 is configured to display information necessary for the game console and execute corresponding operations under a state of control of the central processing unit 140.

Therefore, shapes to be displayed in the driving unit 150 may include text, numbers, and various figures.

The driving unit 150 includes a supplying unit 153 for supplying the object or another object to the user under control of the central processing unit 140.

The object or another object supplied from the supplying unit 153 may refer to, for example, services such as bonus stages, free gifts, and gift certificates that can be used to enjoy extra games.

Further, the driving unit 150 may include the score displaying unit 151 for displaying different scores depending on the color or pattern of the ball, and the lamp lighting unit 152 for displaying different lamp lighting or flashing states depending on the color or pattern of the ball.

When the multi-play game is played, the highest score and the ranking may be displayed in the score displaying unit 151.

The lamp lighting unit 152 may include various light source devices, for example, a general lamp, LED, and LCD.

Only when the ball going into the rim is detected from the image detecting unit 110, it is preferable that the central processing unit 140 receive the color or pattern of the identified ball from the identification unit 120, compare the received result with the pre-stored color or pattern, and control a driving state of the device.

Accordingly, the central processing unit 140 receives the color or pattern of the identified ball from the color identification unit 121 or the pattern identification unit 122, and controls a display state of the device according to the user's commands input through the terminal 130.

The central processing unit 140 of the terminal 130 has clean shot and color shot sensor recognition statistics data distinguishing functions for calculating accurate data of the clean shot and color shot, and obtains an average value of all sensors of each terminal when sensor correction is performed and the multi-play game is played, so that any device has the same ratio of recognition rates for all sensors, and the game may be thereby played evenly.

Further, a billing unit 160 configured to determine input fees and deliver the fees to the central processing unit 140 may be included.

Hereinafter, a game method of the basketball game console using these components according to the invention will be described.

Figure 2:
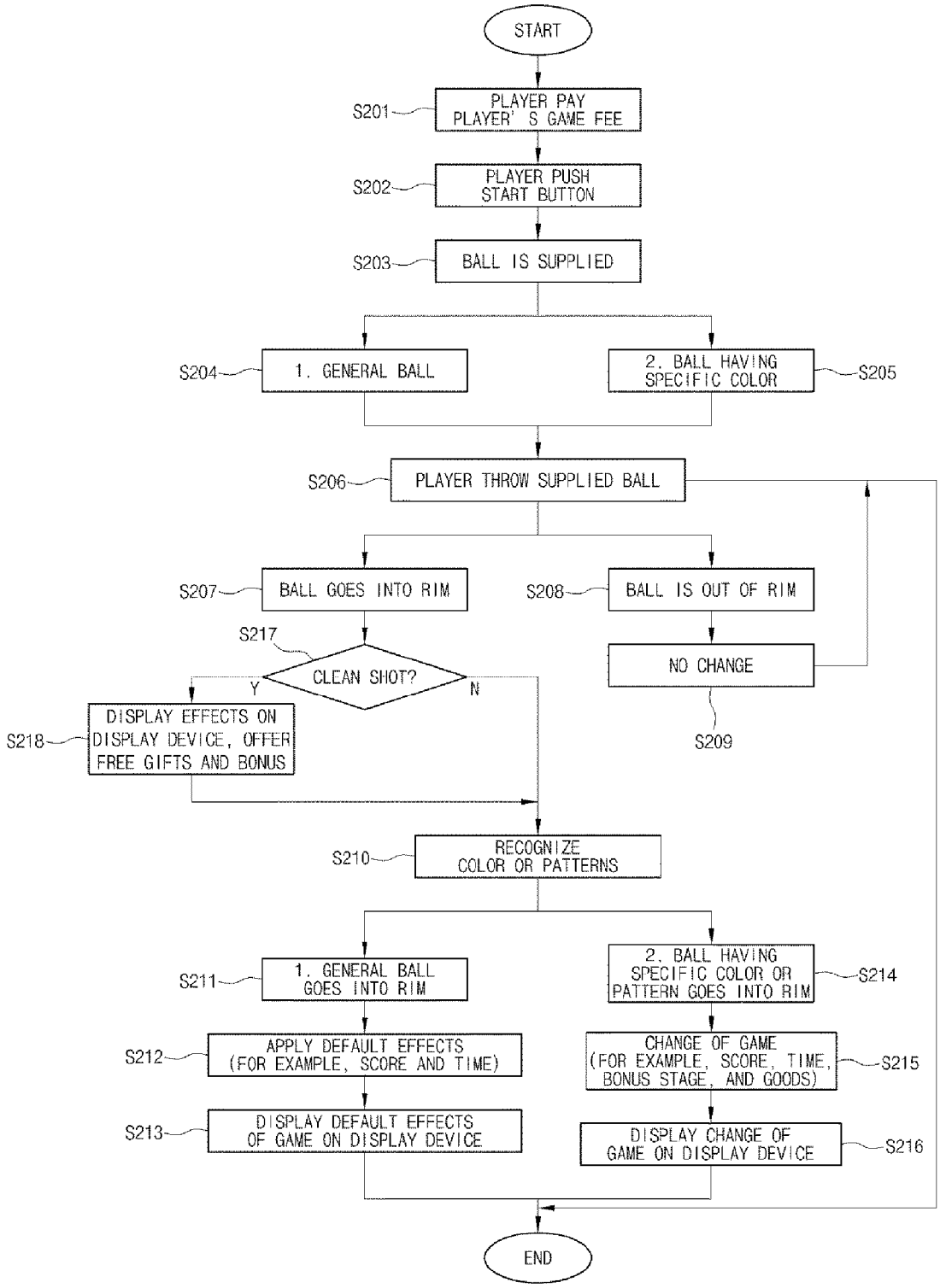
FIG. 2 is a flowchart illustrating operations of the network basketball game console that identifies a color, pattern, or clean shot of the ball according to the invention.

FIG. 2 is a control flowchart illustrating operations of the basketball game console that identifies the color or pattern of the ball according to the invention. As illustrated in FIG. 2, when the user (player) pays or settles game fees, and pushes the start button in the input unit 132, a predetermined number of balls are provided to the user (S201 to S203).

In this case, the balls may be provided with a constant ratio of general balls, balls having a specific color, or balls having a specific pattern formed thereon, or provided at random (S204 to S205).

Then, the user shoots the provided ball toward the rim 116. The shot goes into the rim 116 or falls off the rim 116 (S206).

When the ball goes into the rim and the image detecting unit 110 detects the ball going into the rim, the central processing unit 140 determines whether the ball is the clean shot (S217). When the ball is determined as a clean shot in operation S217, the central processing unit 140 controls the driving unit 150 whereby special effects, free gifts, or a bonus score are offered to make the game more interesting (S218).

When it is determined that the ball is not a clean shot in operation S217, the color identification unit 121 or the pattern identification unit 122 identifies the color or pattern of the ball going into the rim 116. That is, when the ball falls out the rim, there is no change in the operation of the device, and when the ball goes into the rim, the color or pattern of the ball going into the rim is identified (S207 to S210).

Specifically, a successful shot that has passed through the rim without hitting the backboard 180 or the rim 116, or in a case whereby the first detection sensor 111, installed at the lower end of the rim 116, is operated within a predetermined time after the impact detection sensor 115 detects an impact signal, and the shot is determined as a clean shot, then free gifts or bonus scores are offered, score displays of various games and various display functions, such as lamp lighting or flashing, are offered, or a score, time, bonus stage, and goods are provided according to the color or pattern of the corresponding ball.

Therefore, only when the ball going into the rim is detected from the image detecting unit 110, the central processing unit 140 determines whether the ball is a clean shot, and offers free gifts or a bonus score, and then receives the color or pattern of the identified ball from the color identification unit 121 or the pattern identification unit 122, compares the received result with the color or pattern stored in the memory 170 in advance, and controls a driving state of the device.

When a general ball goes into the rim, as an example of default effects, the default effects, such as the score and time, may be displayed in the score displaying unit 151 (S211 to S213).

Alternatively, when a ball having a specific color or pattern goes into the rim, it is possible to display or provide various change conditions such as the score, time, bonus stage, and goods according to the color or pattern of a corresponding ball (S214 to S216).

In this way, according to the invention, it is possible to detect whether the ball going into the rim is a clean shot, identify the color or pattern of the ball, and provide score display of various games and various display functions, such as lamp lighting or flashing, according to each color or pattern.

Hereinafter, the game method of the multi-play game will be described with reference to the drawings.

Figure 10:
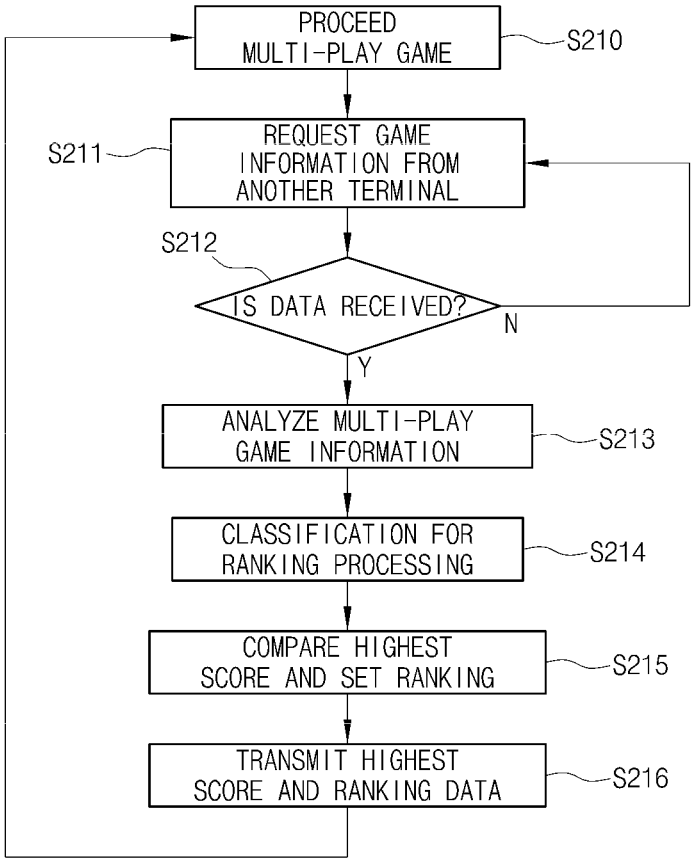
FIG. 10 is a flowchart illustrating operations of calculating a ranking and the highest score in a main terminal when a multi-play game is played.

FIG. 9 is a block diagram illustrating a configuration of the network game console according to the embodiment of the invention. FIG. 10 is a flowchart illustrating operations of calculating the highest score and ranking in the main terminal when the multi-play game is played.

The network game console according to the invention includes at least one basketball game console having the central processing unit 140 configured to obtain game progress information and displays the result in a display window, and the terminal 130 that is connected with the central processing unit 140 of each basketball game console over a wired or wireless network and communicates with one another.

In the network game method using such devices, when the player selects the multi-play game using the multi selection button in the terminal 130, the game starts (S210).

The terminals participating in the multi-play game electrically build a network and the main terminal is selected from among the participating terminals.

The main terminal selected in operation S210 requests game information from the central processing unit 140 of another terminal that participates in the multi-play game and analyzes the game information when the data is received (S211 to S213).

In this case, the game information may include the score according to any one of a color, pattern, and clean shot of the ball going into the rim.

The main terminal aggregates the score of each terminal using such game information, processes the ranking, determines the highest score, and determines the ranking of each terminal (S214 to S215).

The highest score and ranking determined in operations S214 and S215 are transmitted to each terminal, and are displayed (S216).

Figure 11:
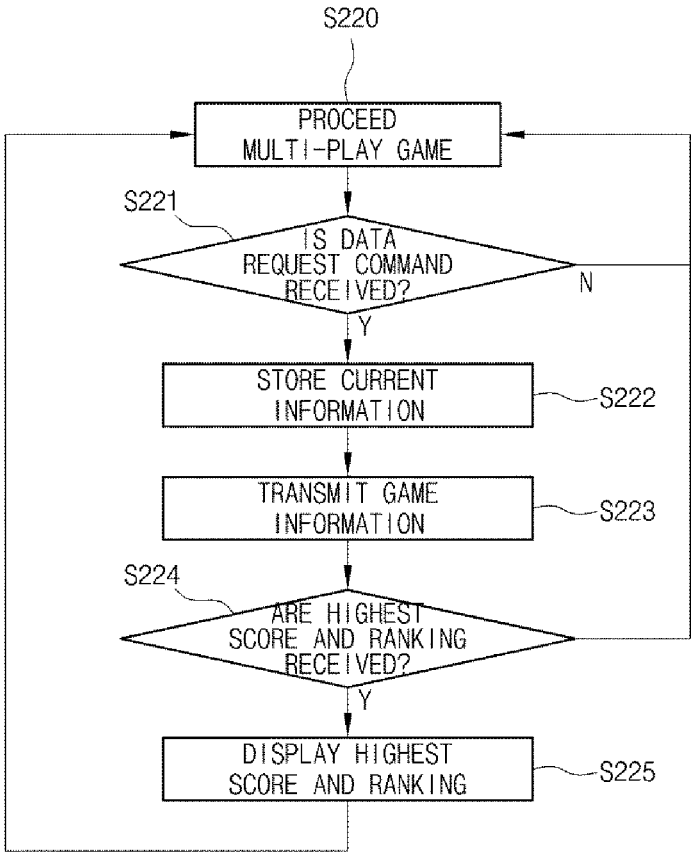
FIG. 11 is a flowchart illustrating operations of displaying a ranking and the highest score in an individual terminal when the multi-play game is played.

FIG. 11 is a flowchart illustrating operations of displaying the ranking and highest score in each terminal that participates in the multi-play game. When the multi-play game is selected (S220), the main terminal determines whether the game information is requested (S221). When it is determined that the information is requested, current game information is stored in its own memory and the game information is simultaneously transmitted to the main terminal (S222 to S223).

After the game information is transmitted to the main terminal in operation S223, when the highest score and ranking are received from the main terminal (S224), the highest score and ranking are displayed in the display setting unit 134 or the score displaying unit 151 of each terminal (S225).

A method of adjusting balance of each terminal will be described with reference to FIGS. 12 to 14.

Figure 12:
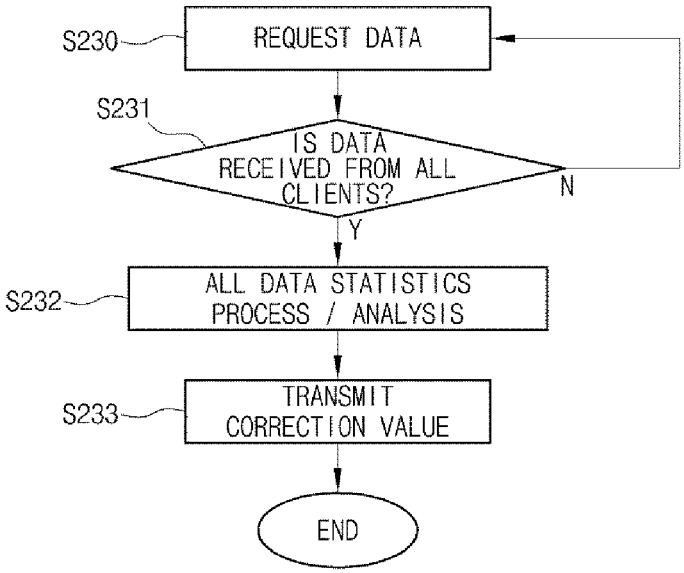
FIG. 12 is a flowchart illustrating operations of adjusting balance.

FIG. 12 is a flowchart illustrating operations of adjusting the balance. As illustrated in FIG. 12, the main terminal requests clean shot and color shot sensor recognition data first from each terminal that participates in the multi-play game (S230).

In operation S231, it is determined whether the data is received from all terminals and all the received data is analyzed (S232).

That is, the main terminal determines an average value based on the analyzed data and sets reference values of clean shot and color shot sensor recognition rates of each terminal with reference to the determined average value.

The reference values of the clean shot and color shot sensor recognition rates set in operation S232 are transmitted to each terminal (S233).

Figure 13:
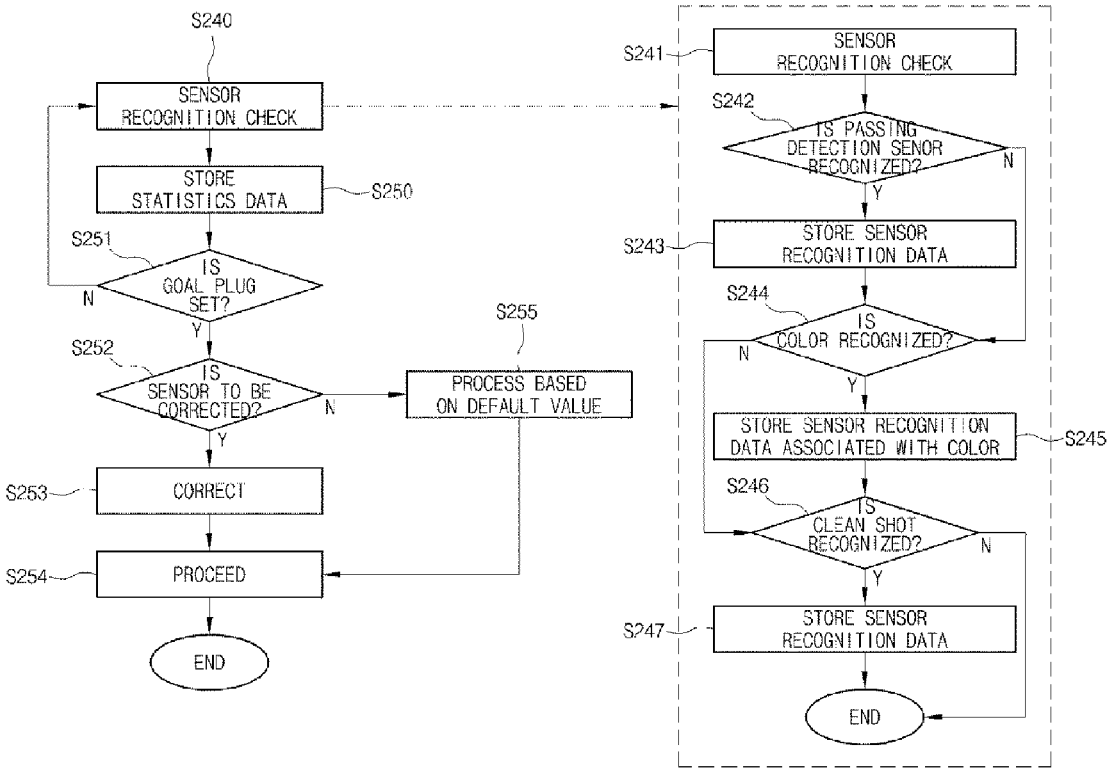
FIG. 13 is a flowchart illustrating operations of calculating a sensor correction value of the individual terminal and performing correction according to the correction value for balance correction.

FIG. 13 is a flowchart illustrating operations of calculating a sensor correction value for the individual terminal and performing corrections according to the correction value for balance correction. The central processing unit 140 of the terminal 130 checks a value of each sensor installed in the basketball game console (S240).

As a specific method, when a sensor recognition check starts (S241), data from the passing detection sensors 111 and 112 is read first, and the recognized data is stored (S242 to S243).

When the data of the passing detection sensors 111 and 112 is stored in operation S243, a color is recognized and associated data is stored (S244 to S245), and then the clean shot data is detected and corresponding data is stored (S246 to S247).

The sensor values detected in operation S240 are stored in the memory 170 as statistics data (S250) and it is determined whether a goal plug is set (S251).

When it is determined that the goal plug is set in operation S251, it is determined whether a corresponding sensor is to be corrected (S252). When it is determined that the correction is necessary, a recognition rate is corrected according to the correction value of the sensor necessary for game progress and recognition of goal types and goal directing settings are performed (S253 to S254). When it is determined that the sensor correction is unnecessary in operation S252, the sensor correction is performed based on a preset default value (S255) and the process proceeds to operation S254.

Figure 14:
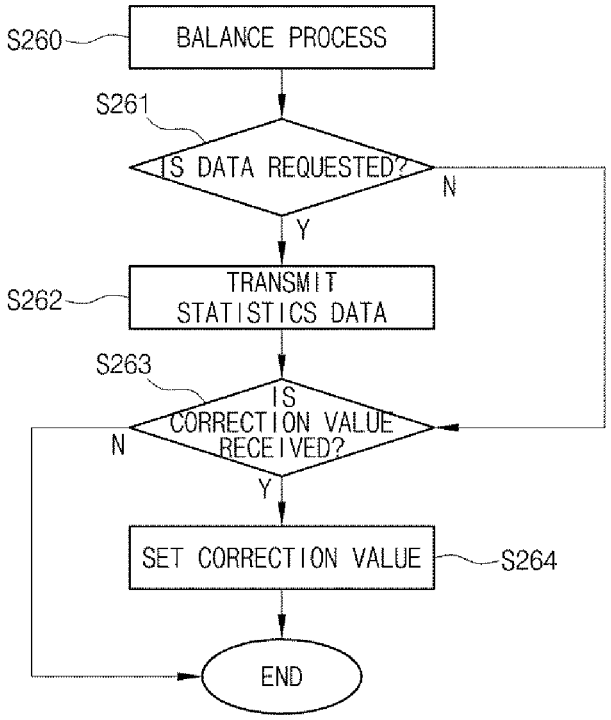
FIG. 14 is a flowchart illustrating balance processing operations when the multi-play game is played.

FIG. 14 is a flowchart illustrating balance processing operations when the multi-play game is played. When aggregation of sensor statistics data for the balance processing in each terminal is completed (S260) and the main terminal requests balance statistics data (S261), the balance statistics data is transmitted to the main terminal (S262). The main terminal determines an average value based on the received data, sets reference values of clean shot and color shot sensor recognition rates of each terminal with reference to the determined average value, and then transmits the correction value to each terminal. Each terminal that has received the correction value reflects the value to recognition processes of the clean shot and color shot sensors with reference to the reference correction value of the received clean shot and color shot sensor recognition (S263 to S264).

With such balance correction, in order to recognize the goal in a recognition system of the goal, such as the clean shot and color shot, the ball needs to go into the rim or additional manipulation is necessary. In the basketball game, the gameplay time may be decreased or increased according to the player's skill level.

When the gameplay time is short, data stored for clean shot and color shot sensor recognition statistics may be insufficient or absent according to the player's tendencies. Therefore, it is preferable that the clean shot and color shot data be stored based on game play progress information when one hundred (100) or more goals are scored in at least one game.

That is, when an average value of the goal success rate of each terminal 130 is less than or greater than the preset average success rate value, based on information obtained from each terminal 130, the main terminal controls the central processing unit 140 such that the success rate is adjusted to be closer to the set average success rate value.

For example, for an actual correction in operation S264, a corresponding terminal is controlled such that a weighted value is added to be closer to the average success rate value when the average value of the goal success rate of each terminal is less than or greater than the preset average success rate value.

Hereinafter, error message processing operations will be described with reference to the drawings.

Figure 15:
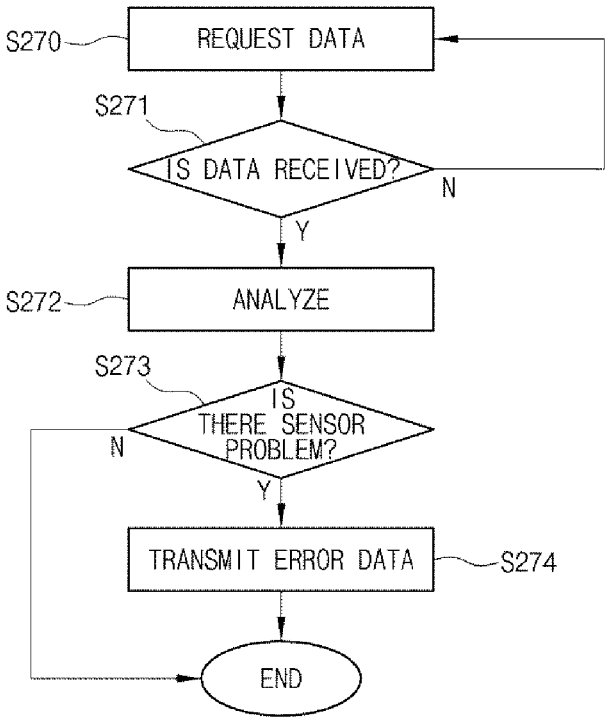
FIG. 15 is a flowchart illustrating error message processing operations in the main terminal.
Figure 16:
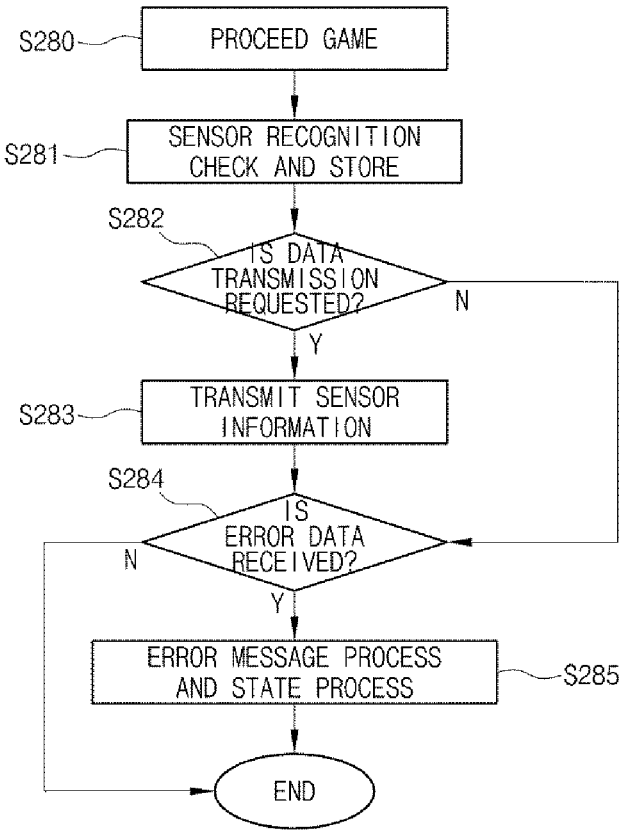
FIG. 16 is a flowchart illustrating error message processing operations in each terminal.

FIG. 15 is a flowchart illustrating error message processing operations in the main terminal FIG. 16 is a flowchart illustrating error message processing operations in each terminal. When the multi-play game is played, the main terminal requests the clean shot and color shot sensor recognition data for balance adjustment from each terminal (S270). When associated data is received from each terminal (S271), the main terminal determines an average value based on the received data, and compares the clean shot and color shot sensor recognition rate of each terminal with reference to the determined average value (S272).

After the reference correction value is set in operation S272, the correction value is transmitted to each terminal. Each terminal that has received the correction value determines whether the sensor in each terminal has a problem with reference to the reference correction value of the received clean shot and color shot sensor recognition (S273).

It is possible to select a sensor having a data value outside the error tolerance with respect to the average value according to the presence of such a problem.

When it is determined that the sensor has a problem in operation S273, error data is transmitted to a corresponding terminal (S274).

FIG. 16 is a flowchart illustrating error message processing operations in each terminal. When it is determined that the multi-play game is played (S280), the central processing unit 140 of each terminal 130 checks a value of each sensor installed in the basketball game console and stores associated data (S281), and when the data is requested from the main terminal (S282), the stored data is read and is transmitted to the main terminal (S283).

The main terminal makes error data through the above operations S270 to S274 based on the received data.

After operation S283 is performed, each terminal waits until the error data is received from the main terminal. When the error data is received (S284), each terminal processes an error message for a corresponding sensor (S285).

Such error message processing is output on a display or as a sound so that the user or manager recognizes the display or sound.

Hereinafter, a correction method according to a player's skill level participating in the multi-play game will be described with reference to the drawings.

Figure 17:
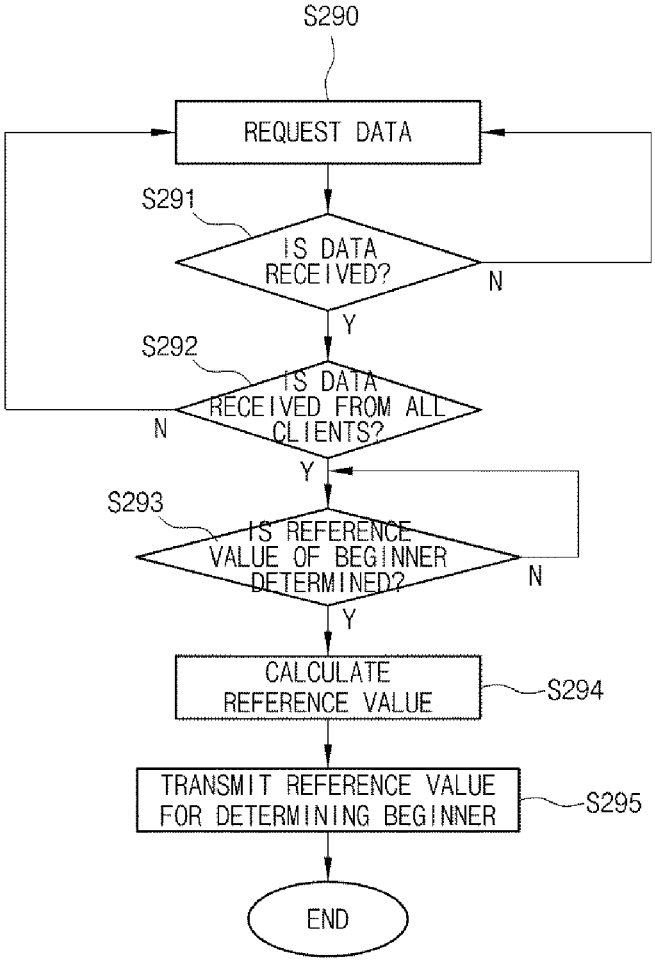
FIG. 17 is a flowchart illustrating operations of determining a reference level of a beginner.

FIG. 17 is a flowchart illustrating operations of determining a reference level for a beginner. As illustrated in FIG. 17, when the multi-play game is played and the average value of the goal success rate of each terminal is less than or greater than the preset average success rate value, the main terminal controls a corresponding terminal such that a weighted value is added to be closer to the average success rate value.

According to the skill level or athletic ability of the player, in general, a person having a better skillset plays the game for a longer time, whereas a person having a poorer skillset plays the game for a shorter time.

Beginner players who play the basketball game for the first time or have a poor athletic sense may lose interest in the basketball game after they play the basketball game at first and will enjoy the game for a short time period.

Here, when the multi-play game is played through network communications, a reference for the beginner player is determined and selected by analyzing game progress information.

An opportunity for playing the basketball game for an extended time is offered to the selected beginner player so that interest and satisfaction for the basketball game is increased.

When the player is determined to be a beginner, it is preferable that a default game time is increased and the determination of clean shots and color shots is lenient.

The reference for level determination is determined based on a default setting value.

As illustrated in FIG. 17, when the multi-play game is played, the main terminal requests game progress information from each terminal (S290).

After operation S290 is performed, when game progress information is received (S291) and it is determined that the game progress information from all terminals is received in operation S292, the main terminal analyzes the patterns of the beginner player based on the game progress information (S293).

A reference value for the identification of a beginner player is determined based on the game information analyzed in operation S293 (S294).

The reference value for the identification of a beginner player may be transmitted from each terminal to the main terminal when the game is played.

When the reference value of the beginner player is determined in operation S294, it is controlled whereby the reference value for the identification of a beginner is transmitted to each terminal and is reflected therein (S295).

Figure 18:
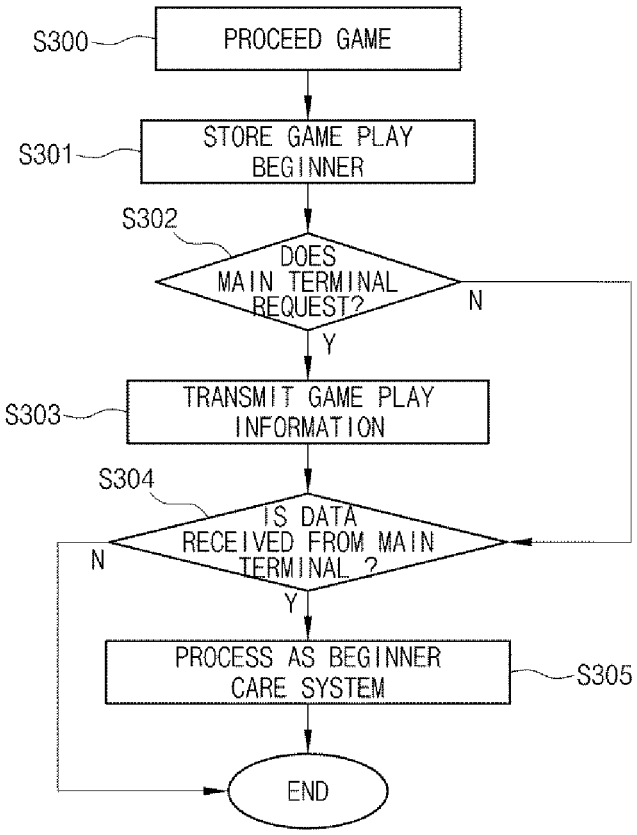
FIG. 18 is a flowchart illustrating correcting operations of each terminal according to the determined beginner level.

FIG. 18 is a flowchart illustrating correcting operations according to the indentified beginner level. When the multi-play game is played, each terminal stores game progress information in its own memory and simultaneously determines whether there is a request from the main terminal (S300 to S302).

When it is determined that there is a request from the main terminal in operation S302, the terminal 130 transmits game progress information to the main terminal (S303), and receives the reference value for determining the beginner set in operations S290 to S295 from the main terminal (S304). The terminal determines whether a current player is a beginner with reference to the reference value for determining the beginner player. When the current player is determined as a beginner, the system is operated as a beginner care system (S305).

Such a beginner care system allows lenient recognition reference values for each sensor or offers a determined extra time in a final gameplay time, thereby providing more basketball shooting opportunities.

For example, when a progress time of 50 seconds is set for stage one and a clean shot condition for a goal score is more than 50 points, it is possible to proceed to the next stage when at least twenty five (25) basketballs are scored via awarding two points for each goal.

That is, as he or she succeeds in gameplay, the player will enjoy the game longer.

Therefore, with reference to gameplay time, one successful goal every two seconds is required. However, since there is no guarantee that the beginner player will attempt one shot every two seconds, and all the basketballs will go into the rim, when the player is determined to be a beginner, extra time may be offered in addition to a predetermined time of 50 seconds, and more shooting opportunities are provided.

The reference value of the beginner level is used to indentify the beginner player with reference to the default setting value determined internally first, and as gameplay proceeds, game progress information is accumulated, and the main terminal integrates the information through network communications, collects statistics, and obtains an average. Therefore, progress trending of the beginner player may be realized.

Moreover, the determination of the beginner player reference may be modified according to the characteristics of a location where the basketball game console is installed.

Therefore, it is preferable that an average number of basketballs going into the rim for the beginner player be determined through network communications and the reference value be reset based on relevant statistics.

While exemplary embodiments of the invention have been described in detail, it will be apparent to those skilled in the art that various changes and modifications may be made without departing from the spirit and scope of the invention, and these changes and modifications are included in the appended claims.

The invention relates to a basketball game connected over a network, the game proceeds while the gradient of the rim or difficulty is adjusted according to the player's skill level, and the ranking and highest score are checked. Therefore, the game may be interestingly, competitively, and fairly played and players may relieve stress and further enjoy the game.

According to the basketball game console and the network basketball game console using the same, it is possible to display scores of various games and provide various services, such as lamp lighting or flashing, bonus stages, and offering free gifts by identifying a color, pattern, and clean shot of the ball going into the rim.

According to the invention, since the gradient of the rim can be adjusted depending on the player's skill level, it is possible for beginners or unskilled players to enjoy increasingly interesting games.

Moreover, according to the invention, since many players can simultaneously play the game, it is possible to check each player's progress and rankings, and accordingly enjoy more competitive games.

Although many players can participate in the game, since it is possible to adjust the difficulty of the games according to respective game levels, players can still enjoy fair and evenly competitive games.

According to the invention, since it is possible to check an wear state of the ball, people can enjoy the game fairly.

The invention claimed is:

1. A network basketball game console comprising:

at least one basketball game console including, an image detecting unit that is positioned at a lower end of a rim having an impact detection sensor, detects a ball going into the rim, and detects images of the ball, an identification unit configured to identify any one of a color, pattern, and clean shot of the ball in the received images, a central processing unit configured to control a state according to the color, pattern, or clean shot of the ball identified in the identification unit when the ball going into the rim is detected from the image detecting unit, and display a screen necessary for game progress; and a driving unit configured to display shapes and execute corresponding operations under state control of the central processing unit;

a terminal that is connected to the central processing unit of each of the basketball game consoles over a wired or wireless network and communicates with each other, is configured to select a single-play game or multi-play game, and includes a display window for displaying information associated with each game; and a main terminal is interconnected with each terminal that participates in the multi-play game, receives game progress information from the central processing unit of each of the terminals, aggregates scores of the basketball game consoles participating in the multi-play game, and displays the score and ranking of each terminal in each basketball game console participating in the multi-play game;

wherein the rim includes:

a rim fixing unit of which one end is coupled to one side of a backboard and the other end is formed to protrude from the backboard;

a rim supporting unit formed to be extended from one end of the rim fixing unit; and an impact alleviation device configured to couple the other end of the rim fixing unit and the rim supporting unit.

2. The network basketball game console of claim 1, wherein, when an average value of a goal success rate of each of the basketball game consoles is less than or greater than a preset average success rate value, the terminal controls each of the central processing units such that the success rate is adjusted to be closer to the average success rate value.

3. The network basketball game console of claim 1, wherein the terminal controls such that a weighted value is added to be closer to the average success rate value when a goal success rate is less than or greater than a preset average success rate value and an error message is output on a display device or as a sound when the success rate is determined as lower than a predetermined level.

4. The network basketball game console of claim 1, wherein, when a goal success score is determined to be a beginner level, the terminal extends gameplay time of a corresponding basketball game console or offers a bonus score.

5. The network basketball game console of claim 1, wherein the image detecting unit includes:

a passing detection sensor configured to detect whether the ball passes through the rim;

a lens; and an image sensor configured to detect images of the ball that have been transmitted to the lens, wherein the central processing unit controls such that the images of the ball detected in the image sensor through the lens are identified when the passing detection sensor detects signals.

6. The network basketball game console of claim 5, further comprising at least one lighting device, wherein the central processing unit controls such that the lighting device turns on when the passing detection sensor or impact detection sensor detects signals.

7. The network basketball game console of claim 6, wherein the passing detection sensor includes:

a first detection sensor installed at the lower end of the rim; and a second detection sensor installed at a lower end of the image sensor, wherein the central processing unit detects the ball going into the rim through the first detection sensor and controls such that the lighting device turns on when the ball is detected through the second detection sensor.

* * * * *